US008268444B2

(12) United States Patent
Okaya

(10) Patent No.: US 8,268,444 B2
(45) Date of Patent: Sep. 18, 2012

(54) CRIMPING COMPOSITE FIBER AND FIBROUS MASS COMPRISING THE SAME

(75) Inventor: Hiroshi Okaya, Hyogo (JP)

(73) Assignees: Daiwabo Holdings Co., Ltd., Osaka (JP); Daiwabo Polytec Co., Ltd., Osaka (JP)

( * ) Notice: Subject to any disclaimer, the term of this patent is extended or adjusted under 35 U.S.C. 154(b) by 0 days.

(21) Appl. No.: 12/444,096

(22) PCT Filed: Mar. 30, 2007

(86) PCT No.: PCT/JP2007/057123

§ 371 (c)(1),
(2), (4) Date: Apr. 2, 2009

(87) PCT Pub. No.: WO2008/041384

PCT Pub. Date: Apr. 10, 2008

(65) Prior Publication Data

US 2009/0318050 A1 Dec. 24, 2009

(30) Foreign Application Priority Data

Oct. 3, 2006 (JP) ..... 2006-272180
Mar. 30, 2007 (JP) ..... 2007-090104

(51) Int. Cl.
*B32B 19/00* (2006.01)
*D04H 1/00* (2006.01)
*D02G 3/00* (2006.01)

(52) U.S. Cl. ..... 428/374; 428/364; 428/370; 428/371; 428/373; 428/365; 442/361; 442/364

(58) Field of Classification Search ..... 428/370
See application file for complete search history.

(56) References Cited

U.S. PATENT DOCUMENTS 4,814,032 A * 3/1989 Taniguchi et al. ..... 156/167
5,298,321 A 3/1994 Isoda et al.
5,512,358 A 4/1996 Shawver et al.
6,274,237 B1 8/2001 Nakajima et al.
(Continued)

FOREIGN PATENT DOCUMENTS

CN 1133620 A 10/1996
(Continued)

*Primary Examiner* — Jennifer Chriss
*Assistant Examiner* — Ricardo E Lopez
(74) *Attorney, Agent, or Firm* — Hamre, Schumann, Mueller & Larson, P.C.

(57) ABSTRACT

The present invention is directed to a crimping conjugate fiber, comprising a first component and a second component, wherein the first component comprises a polybutene-1; the second component comprises a polymer having a melting point higher than that of the polybutene-1 by at least 20° C., or a polymer having a melting initiation temperature (extrapolated melting initiation temperature measured using differential scanning calorimetry (DSC) as defined in JIS-K-7121) of at least 120° C.; in a cross section of the fiber, the first component occupies at least 20% of the surface of the conjugate fiber, and the centroid position of the second component is shifted from the centroid position of the conjugate fiber; and the conjugate fiber is an actualized crimping conjugate fiber in which three-dimensional crimps have been developed or a latently crimpable conjugate fiber in which three-dimensional crimps are developed by heating. Accordingly, a crimping conjugate fiber and a fiber assembly comprising the same are provided in which the elasticity, the bulk recovery property, and the durability are high.

20 Claims, 3 Drawing Sheets

U.S. PATENT DOCUMENTS

| | | | | |
|---|---|---|---|---|
| 6,844,062 | B2 * | 1/2005 | Matsui et al. | 428/370 |
| 2003/0064651 | A1 * | 4/2003 | Nakai et al. | 442/361 |

FOREIGN PATENT DOCUMENTS

| | | | |
|---|---|---|---|
| EP | 1 452 633 | A1 | 9/2004 |
| JP | 49-101669 | | 9/1974 |
| JP | 63-264915 | | 11/1988 |
| JP | 4-240219 | | 8/1992 |
| JP | 5-179511 | | 7/1993 |
| JP | 05-195399 | | 8/1993 |
| JP | 5-195399 | | 8/1993 |
| JP | 5-247724 | | 9/1993 |
| JP | 2001-140158 | | 5/2001 |
| JP | 2003-003334 | | 1/2003 |
| JP | 2001-040531 | | 2/2003 |
| JP | 2003-049360 | | 2/2003 |
| JP | 2003-293219 | | 10/2003 |
| JP | 2005-245542 | | 9/2005 |
| JP | 2006-233381 | | 9/2006 |

* cited by examiner

CRIMPING COMPOSITE FIBER AND FIBROUS MASS COMPRISING THE SAME

TECHNICAL FIELD

The present invention mainly relates to a fiber assembly having high elasticity and high bulk recovery property, and specifically to a conjugate fiber and a fiber assembly comprising the same suitable for a nonwoven fabric.

BACKGROUND ART

Thermally bonded nonwoven fabrics comprising a thermally fused conjugate fiber, containing a low-melting peak component that is exposed at least partially on the surface of the fiber and a high-melting point component that has a melting point higher than that of the low-melting point component, are used in various applications, such as nonwoven fabrics used in hygienic materials, packaging materials, wet tissue, filters, wipers, or the like, nonwoven fabrics used in hard stuffing, chairs, or the like, or molded bodies. In particular, as a urethane foam substitute, there is a growing demand for high elasticity and high bulk recovery property of a nonwoven fabric, that is, a demand for a fiber having high bulk recovery property in the thickness direction. There is a strong demand for a urethane foam substitute because urethane foam is problematic in that, for example, the handling of chemicals used during production is difficult, chlorofluorocarbons are discharged, and disposal after use is difficult. Furthermore, an obtained urethane foam is problematic in that, for example, the feeling when initially compressed is hard, the air permeability is so poor that stuffiness easily occurs, the sound absorbency is insufficient, or the color easily is changed to yellow. Accordingly, various investigations have been conducted on a nonwoven fabric having high elasticity and high bulk recovery property.

Patent Documents 1 and 2 below disclose a conjugate fiber, comprising: a polyester component having a melting point of 200° C. or higher; and a polyether-ester block copolymer component, that is, a so-called elastomer component, having a melting point of 180° C. or lower. Since the sheath component comprises an elastomer component, the degree of freedom in bonding points and the durability when the conjugate fiber is deformed by compression are improved, and, thus, the bulk recovery property is excellent.

Patent Document 3 below discloses an actualized crimping conjugate fiber, comprising: a first component that contains a polytrimethylene terephthalate (PTT)-based polymer; and a second component that contains a polyolefin-based polymer, in particular, a polyethylene, wherein crimps are actualized by shifting the centroid position of the first component from that of the fiber in the cross section of the fiber. This actualized crimping conjugate fiber comprises a polymer having large bending elasticity and small bending hardness as the first component, the cross section of the fiber is eccentric, and the crimps are wavy, and, thus, it is possible to obtain a nonwoven fabric that has high bulk recovery property, is flexible, and has a large initial bulk.

Patent Document 4 below discloses a latently crimpable conjugate fiber and a nonwoven fabric, wherein a core component comprises polyethylene terephthalate (PET), a blend of PET and polybutylene terephthalate (PBT), or a blend polymer of PET and PTT, and a sheath component comprises a linear low-density polyethylene (LLDPE) resin polymerized using a metallocene catalyst.

[Patent Document 1] JP H4-240219A

[Patent Document 2] JP H5-247724A

[Patent Document 3] JP 2003-3334A

[Patent Document 4] JP 2006-233381A

Patent Documents 1 and 2 above try to provide a nonwoven fabric having excellent bulk recovery property by using a polyesterether elastomer in the sheath component, the polyesterether elastomer being a polymer that has rubber elasticity and provides a large degree of freedom in deformation at bonding points. However, since this polyesterether elastomer is a copolymer of a hard polyester and a soft ether, and comprises a soft component having low thermal resistance, this polymer easily is softened by heat, and so-called sag occurs in which the bulk of a nonwoven fabric is reduced during heating. As a result, a conjugate fiber in which the sheath component comprises such a polyesterether elastomer is problematic in that the initial bulk when formed into a nonwoven fabric is small, the thus obtained nonwoven fabric always has a high density, and, thus, their applications are limited. Furthermore, a nonwoven fabric that has been compressed with the application of heat, or that repeatedly was compressed is problematic in that, for example, the fiber-bonding points and the fiber itself are broken or bent, or the fiber strength is lowered, that is, the hardness of this nonwoven fabric becomes significantly lower than that of the original nonwoven fabric.

Patent Documents 3 above and 4 try to provide a nonwoven fabric having excellent bulk recovery property by using a specific polymer in the core, making the specific cross section of the fiber specific, and providing a specific crimping state. However, although the initial thickness (initial bulk) of the nonwoven fabric is large, the bulk recovery property, in particular, the initial bulk recovery property immediately after removal of a load is not sufficient, and, thus, there is a problem in that the applications are limited.

That is to say, in conventional examples, a fiber for a nonwoven fabric having a large initial bulk (having a low density) and excellent bulk recovery property has not been obtained.

DISCLOSURE OF INVENTION

In order to solve the above-described conventional problems, it is an object of the present invention to provide a crimping conjugate fiber and a fiber assembly comprising the same, in which the elasticity, the bulk recovery property, and the durability upon repeated compression are high, and the elasticity, the bulk recovery property, and the durability when used at a high temperature are high.

The present invention is directed to a crimping conjugate fiber, comprising a first component and a second component, wherein the first component comprises a polymer obtained by blending a polybutene-1 with an olefin-based polymer different from the polybutene-1 or a polymer obtained by blending the polybutene-1 with a polymer copolymerized with olefin having a polar group, the second component comprises a polymer having a melting peak temperature higher than that of the polybutene-1 by at least 20° C., or a polymer having a melting initiation temperature of at least 120° C., in a cross section of the fiber, the first component occupies at least 20% of the surface of the conjugate fiber, and the centroid position of the second component is shifted from the centroid position of the conjugate fiber, and the conjugate fiber is an actualized crimping conjugate fiber in which three-dimensional crimps have been developed or a latently crimpable conjugate fiber in which three-dimensional crimps are developed by heating. The melting initiation temperature in the present invention refers to an extrapolated melting initiation temperature measured using differential scanning calorimetry (DSC) as defined in JIS-K-7121.

Furthermore, the present invention is directed to a fiber assembly comprising at least 30 mass % of the crimping conjugate fiber.

LIST OF REFERENCE NUMERALS

Figure 1:
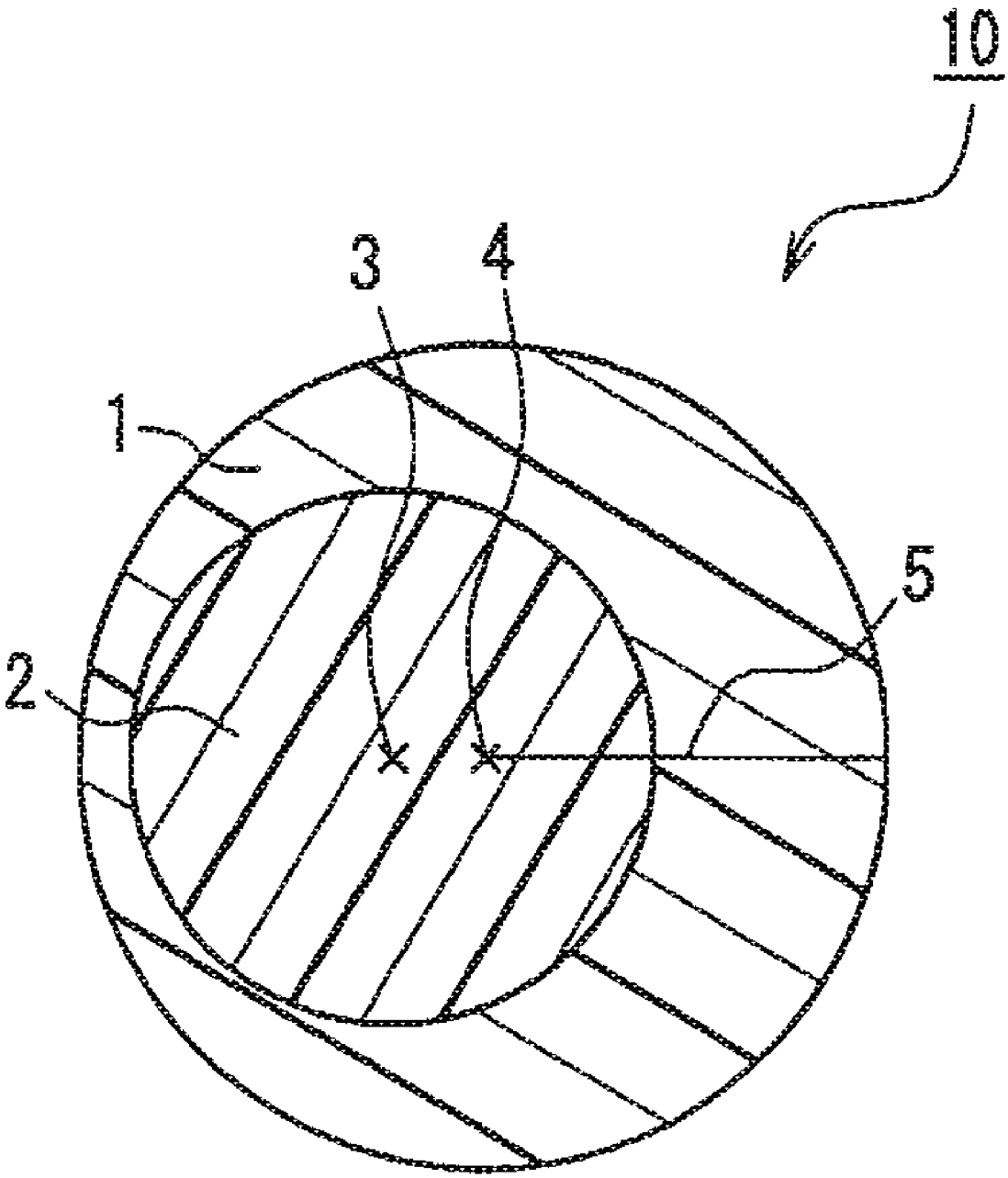
FIG. 1 shows a cross section of a crimping conjugate fiber in an embodiment of the present invention.

1 first component
2 second component
3 centroid position of second component
4 centroid position of conjugate fiber
5 radius of conjugate fiber
10 conjugate fiber

DESCRIPTION OF THE INVENTION

In the crimping conjugate fiber of the present invention, the elasticity, the bulk recovery property, and the durability upon repeated compression are high, and the elasticity, the bulk recovery property, and the durability when used at a high temperature are high. In particular, a fiber assembly comprising a crimping conjugate fiber that has actualized crimps (hereinafter, referred to as an "actualized crimping conjugate fiber") of the present invention has a high initial bulk. Furthermore, in the case of a fiber assembly comprising a crimping conjugate fiber that has latent crimps (hereinafter, referred to as a "latently crimpable conjugate fiber") of the present invention, when a plurality of layers of such a fiber assembly are stacked and shaped by heat, the latent crimps are developed, and, thus, the entanglement between fibrous layers is improved, and the elasticity and the bulk recovery property are increased.

Both the initial bulk and the bulk recovery property of the nonwoven fabric comprising the crimping conjugate fiber of the present invention are superior to those of a nonwoven fabric comprising a conventional elastomer conjugate fiber. Thus, this nonwoven fabric of the present invention can be used also in low-density nonwoven fabric products, such as cushioning materials and other hard stuffing, hygienic materials, packaging materials, filters, materials for cosmetics, pads for women's brassieres, shoulder pads, and the like. Moreover, the nonwoven fabric comprising the crimping conjugate fiber of the present invention also has excellent bulk recovery property at a high temperature (e.g., approximately 60 to 90° C.), and suitably can be used in fields that require thermal resistance, for example, in cushioning materials for vehicles, backing materials for flooring with floor heating, and the like.

In the crimping conjugate fiber of the present invention, a first component (e.g., an bonding component of the sheath) comprises a polybutene-1 (PB-1) or a polymer containing PB-1. This polymer is relatively flexible, but does not contain a soft component as in elastomers, and has excellent thermal resistance. Thus, a nonwoven fabric can be obtained in which the reduction in bulk (sag) during heating is small, and the initial bulk is large. Furthermore, PB-1 is flexible and can maintain its shape (can return to its original shape after deformation) to some extent as in elastomers. Thus, a nonwoven fabric can be obtained in which deformation occurs at bonding points during compression, recovery from the deformation is excellent, and bulk recovery property is high.

It is preferable that a second component of the crimping conjugate fiber comprises a polymer having a melting peak temperature higher than that of PB-1 by 20° C. or higher, or a polymer having a melting initiation temperature of 120° C. or higher, such as polyester. In a case where a polymer that falls within this range is used, the hardness of the second component can be maintained when the fiber is heated at a temperature near the melting peak temperature of the PB-1 component. Examples of polyester that falls within this range include polyethylene terephthalate (PET), polytrimethylene terephthalate (PTT), polybutylene terephthalate (PBT), and their mixtures. The second component is positioned, for example, at the core of the crimping conjugate fiber. When the centroid position of the second component is shifted from the centroid position of the fiber, a fiber assembly can be obtained in which a spring effect is exerted during compression, and the elasticity and the bulk recovery property are high.

The PB-1 used in the present invention has a melting peak temperature measured using DSC as defined in JIS-K-7121 of preferably 115 to 130° C., and more preferably 120 to 130° C. If the melting peak temperature is 115 to 130° C., the thermal resistance is high, and the bulk recovery property at a high temperature is good. In the present invention, the melting peak temperature obtained based on the DSC curve also is referred to as a melting point.

The PB-1 has a melt flow rate (MFR; measurement temperature 190° C., load 21.18 N (2.16 kgf)) measured as defined in JIS-K-7210 of preferably 1 to 30 g/10 min., more preferably 3 to 25 g/10 min., and even more preferably 3 to 20 g/10 min. It is preferable that the MFR is 1 to 30 g/10 min., because the molecular weight of the PB-1 is increased, and, thus, the thermal resistance is good, and the bulk recovery property with the application of heat is high. Furthermore, the taking-up properties and the drawing properties of spun yarns are good.

As the first component, the PB-1 may be used alone or in combination with a polypropylene (PP). It was found that, when the PB-1 is combined with a small amount of polypropylene (PP), problems with drawing properties and thermal shrinkage, and unstable melt viscosity can be solved. The polypropylene may be any of a propylene homopolymer, or a propylene copolymer, such as a random copolymer, a block copolymer, or the like (hereinafter, referred to as "copolymer PP"), but it is preferable to use a homopolymer or a block copolymer in view of thermal shrinkage in the case of the actualized crimping conjugate fiber of the present invention. It is particularly preferable to use a homopolymer, because it has good bulk recovery property although it tends to feel slightly hard. More specifically, the first component of the conjugate fiber comprises a mixture of 60 to 95 mass % of polybutene-1 and 5 to 40 mass % of polypropylene. The first component is positioned, for example, at the sheath of the conjugate fiber. Furthermore, the copolymer PP that is added to the PB-1 in the latently crimpable fiber of the present invention may be either a random copolymer or a block copolymer, but it is preferable to use a random copolymer in view of thermal shrinkage. When the polypropylene, more specifically, the copolymer PP is added to the PB-1, it is preferable to use a mixture of 60 mass % or more and 95 mass % or less of PB-1 and 5 mass % or more and 40 mass % or less of copolymer PP in a mass ratio. The first component is positioned, for example, at the sheath of the crimping conjugate fiber. Here, "copolymer PP" in the present invention refers to copolymer PP comprising more than 50 mass % of propylene component.

In the actualized crimping conjugate fiber, regarding the upper limit of the amount of PP added, as the amount of PP added increases, the drawing properties are improved, the thermal shrinkage is reduced, and the melt viscosity becomes more stable. However, if the amount of PP added is too large, the obtained nonwoven fabric tends to be hard. Furthermore, if the amount of PP added is large, the polymer flexibility becomes poor, and the degree of freedom in deformation at bonding points is reduced, and, thus, the bulk recovery property becomes poor. Furthermore, as the amount of PP added increases, crystallization of the PB-1 is inhibited, and, thus, spun yarns cannot be cooled sufficiently when taken up, and fused yarns are formed easily. Accordingly, it is preferable that the amount added is 40 mass % or less. A preferable lower limit of the amount of PP added is 5 mass %. If the amount of PP added is less than 5 mass %, the effect of preventing the polymer viscosity from being lowered with respect to a melting temperature cannot be obtained. Furthermore, the effect of preventing thermal shrinkage is small. Accordingly, the amount of polypropylene added is 5 mass % or more and 40 mass % or less, preferably 7 mass % or more and 30 mass % or less, and most preferably 10 mass % or more and 25 mass % or less. When the PB-1 and the PP are melt-blended, both polymers are easily compatible. Furthermore, when the polybutene-1 (PB-1) and the polypropylene (PP) that is highly compatible with the PB-1 are blended, the yarn-spinning properties and the drawing properties are improved, and thermal shrinkage of a single fiber is reduced. That is to say, when the PB-1 is used alone, the melt viscosity is low, and the flowability is too high, and, thus, the stability of melt-spun yarns is poor. However, when the PP is blended, the flow characteristics are improved, and, thus, yarns can be spun stably and uniformly. Furthermore, when the PB-1 is used alone, thermal shrinkage is large, and, thus, mechanical crimps become too fine during drying at a temperature near 110° C. after forming the crimps, or the area shrinkage ratio becomes too large during the formation of a nonwoven fabric. Accordingly, a nonwoven fabric may be obtained in which the fabric quality, the initial bulk, and the bulk recovery property are poor. However, when the PP is blended, these problems can be prevented. Furthermore, when the polybutene-1 is used alone, the drawing properties are poor. However, when the PP is blended, the drawing properties also are improved. The reason for this seems to be that, as described above, although the polybutene-1 is problematic in that drawing is difficult due to its large molecular weight (i.e., long molecular chains) and strong intertwining between the molecules, when the PP is blended, the PP enters the gaps between molecular chains of the high-molecular weight polybutene-1 and controls the intertwining between molecular chains of the polybutene-1 suitably.

In the actualized crimping conjugate fiber, the Q value (weight-average molecular weight (Mw)/number-average molecular weight (Mn)) of the PP added is preferably 6 or less, and more preferably 2 to 5. If the Q value is 6 or less, that is, if the molecular weight distribution is small, the content of the high-molecular weight PP is reduced, and, thus, the PP easily enters gaps between molecular chains of the PB-1. As a result, thermal shrinkage is reduced, and the prescribed actualized crimps can be obtained.

The amount of PP added and the Q value of the PP are such that the ratio of the amount added to the Q value is preferably 2.3 or more, more preferably 2.4 or more, and most preferably 2.5 or more. The ratio of the amount of PP added to the Q value refers to an index indicating the ease with which the PP enters gaps between the molecular chains of PB-1, and an index affecting the fiber shrinkage. If the amount of PP added/the Q value is 2.3 or more, it is indicated that the amount of PP added is large or that the Q value is small. Furthermore, the bulk recovery property depends on the amount of PB-1 added. Thus, when the balance between these values is adjusted, the fiber shrinkage can be suppressed, and the bulk recovery property can be increased. For example, in the case where the amount of PP added is small, a sufficient amount of PP enters gaps between molecular chains of the PB-1, and, thus, fiber shrinkage tends to be small. Furthermore, also in the case where the Q value of the PP is small, the PP easily enters gaps between the molecular chains of PB-1, and, thus, fiber shrinkage tends to be small. Conversely, there is no particular limitation on the upper limit of the ratio of the amount added to the Q value, but it is preferably 10 or less in view of the fiber shrinkage suppression and the bulk recovery property.

In the actualized crimping conjugate fiber, the PP has a melt flow rate (MFR; measurement temperature 230° C., load 2.16 kgf (21.18 N)) as defined in JIS-K-7210 of preferably 5 to 30 g/10 min., and more preferably 6 to 25 g/10 min. If the MFR is 5 to 30 g/10 min., a reduction in the melt viscosity of PB-1 can be suppressed. Since the PP has an appropriate molecular weight to enter the gaps between the molecular chains of PB-1, a uniform fiber can be obtained, and thermal shrinkage can be reduced.

In the actualized crimping conjugate fiber, it is preferable that the number of crimps is 5 per 25 mm or more and 25 per 25 mm or less. If the number of crimps is less than 5 per 25 mm, the cardability tends to be lowered, and the initial bulk and the bulk recovery property of the nonwoven fabric tends to become poor. On the other hand, if the number of crimps is more than 25 per 25 mm, since the number of crimps is too large, its cardability is lowered, the quality of the nonwoven fabric becomes poor, and the initial bulk of the nonwoven fabric is reduced, which is not preferable.

Furthermore, of the crimping conjugate fiber, the latently crimpable conjugate fiber to which the copolymer PP has been added is characterized in that this latently crimpable conjugate fiber has a dry thermal shrinkage ratio at 120° C. measured as defined in JIS-L-1015 of.

(1) 50% or more as measured at an initial load of 0.018 mN/dtex (2 mg/de), and (2) 5% or more as measured at an initial load of 0.45 mN/dtex (50 mg/de). If the dry thermal shrinkage ratio at 120° C. falls within this range, when heating a fiber assembly comprising this latently crimpable fiber, the latent crimps of the latently crimpable conjugate fiber can be developed sufficiently.

In the latently crimpable conjugate fiber, regarding the upper limit of the amount of copolymer PP added, as the amount added increases, the drawing properties are improved and thermal shrinkage increases. However, if the amount added is too large, the bulk recovery property of the obtained nonwoven fabric tends to be small. Furthermore, as the amount of copolymer PP added increases, crystallization of the PB-1 is inhibited, and, thus, spun yarns cannot be cooled sufficiently when taken up, and fused yarns are formed easily. Accordingly, it is preferable that the amount added is 40 mass % or less. When the copolymer PP is added, the amount added is more than 0 mass % and 40 mass % or less, preferably 5 mass % or more and 30 mass % or less, and most preferably 10 mass % or more and 25 mass % or less. When the PB-1 and the copolymer PP are melt-blended, both polymers are easily compatible. Furthermore, when the polybutene-1 (PB-1) and the copolymer PP that is highly compatible with the PB-1 are blended, the yarn-spinning properties and the drawing properties are improved. That is to say, when the copolymer PP is blended with the PB-1, the flow characteristics are improved, and, thus, yarns can be spun stably and uniformly. Furthermore, when the copolymer PP is blended, the drawing properties also are improved. The reason for this seems to be that, as described above, although the polybutene-1 is problematic in that drawing is difficult due to its large molecular weight (i.e., long molecular chains) and strong intertwining between the molecules, when the copolymer PP is blended, the copolymer PP enters the gaps between the molecular chains of the high-molecular weight polybutene-1 and controls the intertwining between molecular chains of the polybutene-1 suitably.

In the latently crimpable conjugate fiber, the copolymer PP has a melt flow rate (MFR; measurement temperature 230° C., load 21.18 N (2.16 kgf)) as defined in JIS-K-7210 of preferably 50 g/10 min or less, and more preferably 2 to 30 g/10 min.

In the latently crimpable conjugate fiber, it is preferable that the copolymer PP is at least one type selected from an ethylene-propylene copolymer and an ethylene-butene-1-propylene terpolymer. In a case where the copolymer PP is an ethylene-propylene copolymer, a preferable copolymerization ratio is such that ethylene:propylene=1:99 to 3:7 in a mass ratio. In a case where the copolymer PP is an ethylene-butene-1-propylene terpolymer, a preferable copolymerization ratio is such that, in a mass ratio, 0.5 to 15 of ethylene, 0.5 to 15 of butene-1, and 70 to 99 of propylene are contained.

In the latently crimpable conjugate fiber, the copolymer PP is an ethylene-propylene copolymer having a ratio (Q value) between the weight-average molecular weight (Mw) and the number-average molecular weight (Mn) of preferably 3 or more, and more preferably 4 to 7. If the Q value is 3 or more, that is, if the molecular weight distribution is large, the content of the high-molecular weight PP increases, and, thus, the copolymer PP does not enter the gaps between the molecular chains of the PB-1 as much. As a result, thermal shrinkage can be increased.

In the crimping conjugate fiber of the present invention, examples of the polymer that additionally can be blended into the first component include: olefin-based polymers, such as polypropylene, and polyethylene; polymers copolymerized with, for example, olefin having a polar group, such as a vinyl group, a carboxyl group, and maleic anhydride; styrene-based and other elastomers, as long as high bulk and bulk recovery property are not inhibited. Furthermore, examples of the additives include resins, such as ionomers, viscosity-inducing agents, such as terpene, and the like.

It is preferable that the second component is a polymer having excellent bending elasticity. Examples thereof include: polyesters, such as polyethylene terephthalate, polybutylene terephthalate, polytrimethylene terephthalate, polyethylene naphthalate, and polylactic acid; polyamides, such as Nylon 6, Nylon 66, Nylon 11, and Nylon 12; polypropylenes; polycarbonates; and polystyrenes. The second component is particularly preferably polyester, and most preferably polytrimethylene terephthalate (PTT).

Examples of the PTT preferably used in the present invention include PTT homopolymer resins, PTT copolymer resins mentioned below, and blends of the PTT and other polyester-based resins. It is possible to use PTT copolymerized with 10 mass % or less of acid component such as isophthalic acid, succinic acid, or adipic acid, or glycol component such as 1,4 butanediol or 1,6 hexanediol, polytetramethylene glycol, or polyoxymethylene glycol, or PTT blended with 50 mass % or less of other polyester-based resin such as PET or PBT. It is not preferable that the copolymerized component is contained in a ratio of more than 10 mass %, because the bending elastic modulus is reduced. On the other hand, it is not preferable that other polyester-based resins are blended in a ratio of more than 50 mass %, because the overall quality becomes close to that of the blended other polyester-based resins.

The intrinsic viscosity [η] of the PTT is preferably 0.4 to 1.2, and more preferably 0.5 to 1.1. If the intrinsic viscosity [η] falls within this range, a latently crimpable conjugate fiber having excellent productivity and excellent bulk recovery property can be obtained. The "intrinsic viscosity [q]" here refers to a value obtained based on Equation 1 below measured using an ostwald viscometer with an o-chlorophenol solution at 35° C.

$$[\eta] = \lim_{c \to 0} \frac{1}{\{C \times (\eta r - 1)\}}$$

(where, ηr: value obtained by dividing the viscosity of a diluted solution of a sample dissolved in o-chlorophenol with a purity of 98% or more at 35° C., by the concentration of the entire solution measured at the same temperature, C: the weight (g) of a solute in 100 ml of the solution)

If the intrinsic viscosity is less than 0.4, the molecular weight of the resin is too low, and, thus, the yarn-spinning properties are poor, the fiber strength is low, and the practicability is poor. If the intrinsic viscosity is more than 1.2, the molecular weight of the resin increases, and the melt viscosity becomes too high, and, thus, it is difficult to spin yarns well because a single yarn is broken or the like, which is not preferable.

The PTT has a melting peak temperature measured using DSC as defined in JIS-K-7121 of preferably 180° C. to 240° C., and more preferably 200° C. to 235° C. If the melting peak temperature is 180 to 240° C., the weather resistance is high, and the bending elastic modulus of the obtained crimping conjugate fiber can be increased.

Furthermore, various additives, such as an antistatic agent, a pigment, a flattening agent, a thermal stabilizer, a light stabilizer, a flame retardant, an antibacterial agent, a lubricant, a plasticizer, a softening agent, an antioxidant, an ultraviolet absorber, a crystal nucleating agent, and the like, may be added as necessary to the second component according to application purposes, as long as they do not impair the objects and effects of the present invention.

The combination ratio (second component (core)/first component (sheath)) is preferably 8/2 to 3/7 (volume ratio), more preferably 7/3 to 4/6, and most preferably 6/4 to 4.5/5.5. The core component mainly contributes to the bulk recovery property, and the sheath component mainly contributes to the strength of the nonwoven fabric and the hardness of the nonwoven fabric. If the combination ratio is 8/2 to 3/7, both the strength and the hardness of the nonwoven fabric, and the bulk recovery property can be good. If the sheath content in the combination ratio is too large, the strength of the nonwoven fabric increases, but the obtained nonwoven fabric tends to be hard, and the bulk recovery property tends to be poor. On the other hand, if the core content is too large, the number of bonding points becomes too small, and, thus, the strength of the nonwoven fabric tends to be reduced, and the bulk recovery property tends to be poor.

In the present invention, the centroid position of the second component is shifted from the centroid position of the conjugate fiber. FIG. 1 shows a cross section of a crimping conjugate fiber in an embodiment of the present invention. A first component 1 is positioned around a second component 2, and the first component 1 occupies at least 20% of the surface of a conjugate fiber 10. Accordingly, the surface of the first component 1 is melted during thermal bonding. A centroid position 3 of the second component 2 is shifted from a centroid position 4 of the conjugate fiber 10. The shift ratio (hereinafter, may be referred to as an "eccentricity") refers to a numerical value represented by Equation 2 below, when an enlarged image of the cross section of the conjugate fiber is captured using an electron microscope or the like, the centroid position 3 of the second component 2 is taken as C1, the centroid position 4 of the conjugate fiber 10 is taken as Cf, and a radius 5 of the conjugate fiber 10 is taken as rf.

$$\text{Eccentricity}(\%)=[|Cf-C1|/rf]\times 100$$

It is preferable that the cross section of the fiber in which the centroid position 3 of the second component 2 is shifted from the centroid position 4 of the fiber is of the eccentric sheath-core type shown in FIG. 1, or a parallel type. In some cases, a plurality of cores may exist, or a group of a plurality of cores may exist at a position shifted from the centroid position of the fiber. It is particularly preferable that the cross section of the fiber is of the eccentric sheath-core type, because desired crimps easily can be developed during heating. The eccentricity of the eccentric sheath-core conjugate fiber is preferably 5 to 50%, and more preferably 7 to 30%. Furthermore, the second component in the cross section of the fiber may be in irregular shapes such as an ellipse, a Y, an X, a # shape, a polygon, or a star, as well as a circle. The latently crimpable conjugate fiber 10 in the cross section may be in irregular shapes such as an ellipse, a Y, an X, a # shape, a polygon, or a star, or in a hollow shape, as well as a circle.

Figure 2A:
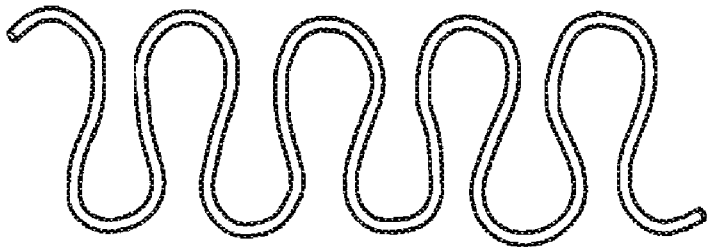
FIGS. 2A to 2C show the crimping states of crimping conjugate fibers in an embodiment of the present invention.
Figure 2B:
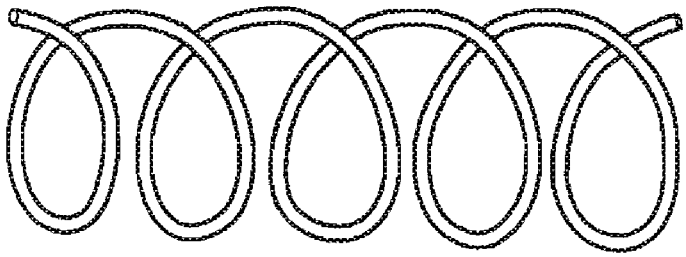
Figure 2C:
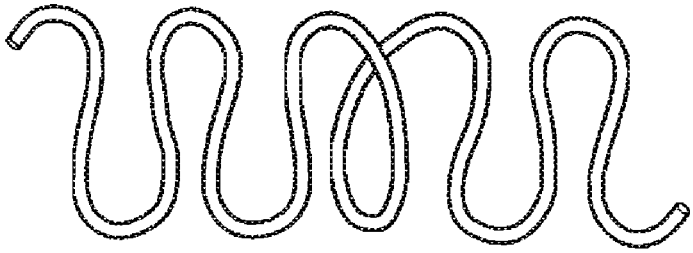
Figure 3:
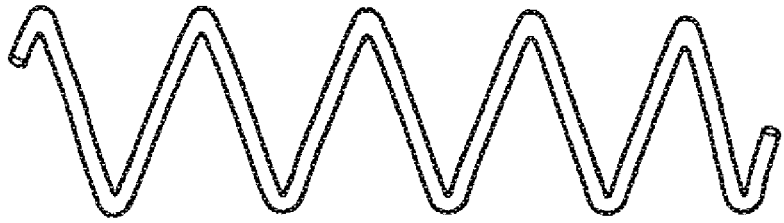
FIG. 3 shows conventional mechanical crimps.
Figure 4:
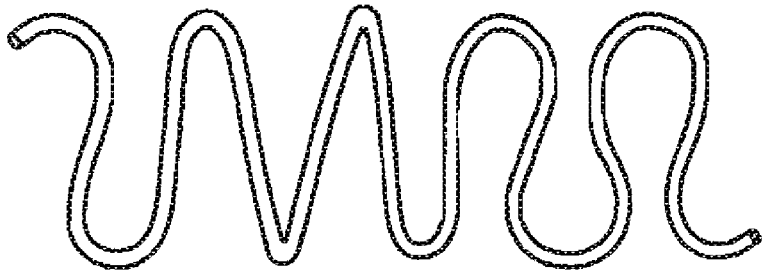
FIG. 4 shows the crimping state of a crimping conjugate fiber in another embodiment of the present invention.

FIGS. 2A to 2C show the crimping states of crimping conjugate fibers in an embodiment of the present invention. The term "wavy crimps" in the present invention refers to crimps having crests curved as shown in FIG. 2A. The term "spiral crimps" refers to crimps having crests spirally curved as shown in FIG. 2B. The present invention also includes crimps as shown in FIG. 2C in which wavy crimps and spiral crimps are combined, ordinary mechanical crimps as shown in FIG. 3, and crimps as shown in FIG. 4 in which the acute-angled mechanical crimps and the wavy crimps as shown in FIG. 2A are combined. In the present invention, the wavy crimps and the spiral crimps collectively are referred to as "three-dimensional crimps" as distinguished from the mechanical crimps.

In the actualized crimping conjugate fiber of the present invention, it is particularly preferable to use the wavy crimps as shown in FIG. 2A or the crimps as shown in FIG. 2C in which the wavy crimps and the spiral crimps are combined, because all of its cardability, initial bulk, and bulk recovery property can be good.

Next, a method for producing an actualized crimping conjugate fiber, as an embodiment of the crimping conjugate fiber of the present invention, will be described. The actualized crimping conjugate fiber can be produced in the following manner. First, the first component comprising 50 mass % or more of polybutene-1, such as a component comprising 60 to 95 mass % of polybutene-1 and 5 to 40 mass % of polypropylene, and the second component comprising a polymer having a melting peak temperature higher than that of the polybutene-1 by 20° C. or higher, or a polymer having a melting initiation temperature (extrapolated melting initiation temperature measured based on differential scanning calorimetry (DSC) as defined in JIS-K7121) of 120° C. or higher are prepared. Then, a composite (conjugate) nozzle arranged so that, in the cross section of the fiber, the first component occupies at least 20% of the surface of the fiber, and the centroid position of the second component is shifted from the centroid position of the fiber, such as an eccentric sheath-core composite (conjugate) nozzle, is used to perform melt-spinning at a yarn-spinning temperature of 240 to 330° C. for the second component and at a yarn-spinning temperature of 200 to 300° C. for the first component. The yarns are taken up at a taking-up speed of 100 to 1500 m/min., to obtain spun yarn filaments. Then, drawing is performed at a drawing ratio of 1.8 times or more at a drawing temperature that is the glass transition point of the second component or higher and lower than the melting point of the first component. It is more preferable that the lower limit of the drawing temperature is higher than the glass transition point of the second component by 10° C. It is more preferable that the upper limit of the drawing temperature is 90° C. If the drawing temperature is lower than the glass transition point of the second component, it is difficult for crystallization of the first component to progress, and, thus, thermal shrinkage tends to increase, and the bulk recovery property tends to be small. The reason for this is that, if the drawing temperature is the melting point of the first component or higher, fiber portions are fused. It is more preferable that the lower limit of the drawing ratio is 2 times. It is more preferable that the upper limit of the drawing ratio is 4 times. If the drawing ratio is less than 1.8 times, the drawing ratio is too low, and, thus, a fiber in which wavy crimps and/or spiral crimps are developed is difficult to obtain, the initial bulk is reduced, and the rigidity of the fiber itself is reduced. Thus, the qualities in the process for producing a nonwoven fabric such as cardability tend to be poor, and the bulk recovery property also tends to be poor. At that time, annealing may be performed if necessary before or after the drawing in an atmosphere of dry heat, wet heat, steam heat, or the like at 90 to 115° C.

Before or after adding a fiber-treating agent as necessary, 5 crimps per 25 mm or more and 25 crimps per 25 mm or less are formed using a known crimper such as a stuffer-box crimper. It is preferable that the crimps after passing through the crimper are saw-toothed (mechanical) crimps and/or wavy crimps. If the number of crimps is less than 5 per 25 mm, the cardability tends to be lowered, and the initial bulk and the bulk recovery property of the nonwoven fabric tend to become poor. On the other hand, if the number of crimps is more than 25 per 25 mm, since the number of crimps is too large, the cardability is lowered, the quality of the nonwoven fabric becomes poor, and the initial bulk of the nonwoven fabric may be reduced.

Moreover, it is preferable that, after the crimps are formed by the crimper, annealing is performed in an atmosphere of dry heat, wet heat, or steam heat at 90 to 115° C. More specifically, it is preferable that, after the fiber-treating agent is added, crimps are formed by the crimper, and then annealing and drying are performed simultaneously in an atmosphere of dry heat at 90 to 115° C., because the processes can be simplified. If annealing is performed at a temperature lower than 90° C., the dry thermal shrinkage ratio tends to increase, predetermined actualized crimps cannot be obtained, and, thus, the quality of the obtained nonwoven fabric may be irregular, or the productivity may be lowered.

The actualized crimping conjugate fiber obtained by the above-described method mainly has at least one type of crimp selected from wavy crimps and spiral crimps as shown in FIGS. 2A to 2C in an amount of 5 per 25 mm or more and 25 per 25 mm or less. This actualized crimping conjugate fiber is preferable because a nonwoven fabric having high bulk can be obtained without lowering the carding properties described later. Then, the fiber is cut into a piece having a desired fiber length, to obtain an actualized crimping conjugate fiber. It is more preferable that the number of crimps is 10 to 20 per 25 mm.

Furthermore, the actualized crimping conjugate fiber in which crimps have been developed in the conjugate fiber has at least one type of actualized crimp (three-dimensional crimps) selected from wavy crimps and spiral crimps. In the state of the fiber, the crimps may be actualized crimps in which three-dimensional crimps fully have been developed, or may be actualized crimps in which slightly more crimping that will be developed (that will be developed when the fiber is heated) remains. Here, it is not preferable that approximately more than 25 crimps per 25 mm are developed when the fiber is heated (heated to a temperature so as to produce a nonwoven fabric as described later, for example), because the cardability may be lowered.

Next, a method for producing a latently crimpable conjugate fiber, as an embodiment of the crimping conjugate fiber of the present invention, will be described. The latently crimpable conjugate fiber can be produced in the following manner.

First, the first component comprising 50 mass % or more of polybutene-1, such as a component comprising 60 to 95 mass % of polybutene-1 and 5 to 40 mass % of copolymer PP, and the second component comprising a polymer having a melting peak temperature higher than that of the polybutene-1 by 20° C. or higher, or a polymer having a melting initiation temperature of 120° C. or higher are prepared. Then, a composite (conjugate) nozzle arranged so that, in the cross section of the fiber, the first component occupies at least 20% of the surface of the fiber, and the centroid position of the second component is shifted from the centroid position of the fiber, such as an eccentric sheath-core composite (conjugate) nozzle, is used to perform melt-spinning at a yarn-spinning temperature of 240 to 330° C. for the second component and at a yarn-spinning temperature of 200 to 300° C. for the first component. The yarns are taken up at a taking-up speed of 100 to 1500 m/min., to obtain spun yarn filaments. Then, drawing is performed at a drawing ratio of 1.5 times or more at a drawing temperature that is the glass transition point of the second component or higher and lower than the melting peak temperature of the polybutene-1. It is more preferable that the lower limit of the drawing temperature is higher than the glass transition point of the second component by 10° C. It is more preferable that the upper limit of the drawing temperature is 90° C. If the drawing temperature is lower than the glass transition point of the second component, it is difficult for crystallization of the PB-1 to progress, and, thus, the bulk recovery property tends to be small. The reason for this is that, if the drawing temperature is the melting peak temperature of the PB-1 or higher, fiber portions are fused. It is more preferable that the lower limit of the drawing ratio is 2 times. It is more preferable that the upper limit of the drawing ratio is 4 times. If the drawing ratio is less than 1.5 times, the drawing ratio is too low, and, thus, it is difficult to develop crimps during heating, the initial bulk is reduced, and the rigidity of the fiber itself is reduced. Thus, the qualities imparted by the process for producing a nonwoven fabric such as cardability tend to be poor, and the bulk recovery property also tends to be poor.

Before or after adding a fiber-treating agent as necessary, 5 crimps per 25 mm or more and 25 crimps per 25 mm or less are formed using a known crimper such as a stuffer-box crimper. If the number of crimps is less than 5 per 25 mm or more than 25 per 25 mm, the cardability may be lowered.

Moreover, it is preferable that, after crimps are formed by the crimper, annealing is performed in an atmosphere of dry heat, wet heat, or steam heat at 50° C. or higher and 90° C. or lower, preferably 60° C. or higher and 80° C. or lower, and more preferably 60° C. or higher and 75° C. or lower. More specifically, it is preferable that, after the fiber-treating agent is added, crimps are formed by the crimper, and then annealing and drying are performed simultaneously in an atmosphere of dry heat at 50° C. or higher and 90° C. or lower, because the processes can be simplified. If the annealing temperature is 50° C. or higher and 90° C. or lower, a desired thermal shrinkage ratio can be obtained, and a latently crimpable conjugate fiber can be obtained in which crimps are developed during heating. Furthermore, this fiber has high cardability.

The dry thermal shrinkage ratio of the latently crimpable conjugate fiber is measured as defined in JIS-L-1015. The dry thermal shrinkage ratio is 50% or more as measured at an initial load of 0.018 mN/dtex (2 mg/de) and 5% or more as measured at an initial load of 0.45 mN/dtex (50 mg/de), preferably 60% or more as measured at an initial load of 0.018 mN/dtex and 5% or more as measured at an initial load of 0.45 mN/dtex, and more preferably 70% or more as measured at an initial load of 0.018 mN/dtex and 10% or more as measured at an initial load of 0.45 mN/dtex.

The initial load refers to a load applied when the fiber length is measured before and after heating. When the initial load is 0.018 mN/dtex (2 mg/de), the load is small, and, thus, the fiber length after heating can be measured in a state where three-dimensional crimps that have been developed are maintained. Accordingly, this dry thermal shrinkage ratio can be considered to be an index indicating the degree of shrinkage (i.e., the degree of apparent shrinkage) resulting from development of three-dimensional crimps. Conversely, when the initial load is 0.450 mN/dtex (50 mg/de), the fiber is stretched strongly by the load, and, thus, the fiber length after heating is measured in a state where three-dimensional crimps that have been developed in the fiber are relatively "stretched". That is to say, this dry thermal shrinkage ratio of a single fiber indicates the degree of shrinkage in the fiber itself resulting from heating. It seems that, if the dry thermal shrinkage ratio of a single fiber measured with these two initial loads falls within this range, the latently crimpable conjugate fiber of the present invention has excellent development of three-dimensional crimps, and the crimps are developed well.

The fiber assembly of the present invention comprises at least 30 mass % of the crimping conjugate fiber. If the content of the crimping conjugate fiber is 30 mass % or more, the elasticity, the bulk recovery property, and other characteristics can be kept high. Examples of the fiber assembly include knit fabrics, woven fabrics, nonwoven fabrics, and the like.

Examples of the fibrous web form constituting the nonwoven fabric of the present invention include a parallel web, a semi-random web, a random web, a cross laid web, a criss-crossed web, an air laid web, and the like. The fibrous web exerts a higher effect when the first component is subjected to thermal bonding. If necessary, the fibrous web may be subjected to needle punching or hydro-entanglement before heating. There is no specific limitation on the means for heating, but it is preferable to use a heating machine in which the pressure applied, such as air pressure, is not so large, such as a heating machine that lets hot air through, a heating machine that vertically blows hot air, an infra-red heating machine, or the like, in order for the function of the crimping conjugate fiber of the present invention to be exerted sufficiently.

In the case where the crimping fiber contained in a fibrous web is the actualized crimping conjugate fiber, the heating temperature of the fibrous web may be set to the range in which wavy crimps and/or spiral crimps that have been developed in the crimping conjugate fiber do not disappear during heating. For example, when the melting peak temperature of the PB-1 is taken as Tm, the temperature is set to the range from Tm−10 (° C.) to a temperature lower than the melting peak temperature of the second component, and preferably set to the range from Tm−10 (° C.) to Tm+80 (° C.). It is more preferable that, when PP is added, the heating temperature is set to the range from Tm−10 (° C.) to the melting peak temperature of PP+40° C., and preferably to the range from 160° C. to 200° C. It is particularly preferable that at least the PB-1 of the actualized crimping conjugate fiber is melted so that fiber portions are thermally fused, because fiber-connecting points can be made firmer, and the bulk recovery property is improved.

In the case where the crimping fiber contained in a fibrous web is a latently crimpable conjugate fiber, the heating temperature may be set to the range in which crimps are developed. For example, when the melting peak temperature of PB-1 is taken as Tm, the temperature is set to the range from Tm−10 (° C.) to a temperature lower than the melting point of the second component, and preferably set to the range from Tm−10 (° C.) to Tm+60 (° C.). It is particularly preferable that at least the PB-1 of the latently crimpable conjugate fiber is melted so that fiber portions are thermally fused, because fiber-connecting points can be made firmer, and the bulk recovery property is improved. It is most preferable that the fiber portions are thermally fused at a temperature of 130° C. to 180° C.

The fiber assembly (hereinafter, also referred to as a "nonwoven fabric") preferably has an initial bulk recovery ratio of 60% or more and a prolonged bulk recovery ratio of 85% or more, and more preferably an initial bulk recovery ratio of 65% or more and a prolonged bulk recovery ratio of 85% or more, as in the following measurements at 25° C.

(1) Bulk Recovery Ratio

A necessary number of layers obtained by cutting the nonwoven fabric into a square piece with 10 cm-long sides are stacked so that the total mass per unit area is approximately 1000 g/m$^2$, and an initial total thickness ($T_0$) is measured. A weight having a load of 9.8 kPa in the shape of a square with 10 cm-long sides is placed on the stacked nonwoven fabric layers. The load is applied in an atmosphere at 25° C. for 24 hours, and removed 24 hours later. A total thickness ($T_1$) of the stacked nonwoven fabric layers immediately after removal of the load and a total thickness ($T_2$) at 24 hours after removal of the load are measured, and the bulk recovery ratios of the nonwoven fabric are calculated using the following equations, which respectively are taken as the initial bulk recovery ratio and the prolonged bulk recovery ratio.

$$\text{Initial bulk recovery ratio}(\%)=(T_1/T_0)\times 100$$

$$\text{Prolonged bulk recovery ratio}(\%)=(T_2/T_0)\times 100$$

A nonwoven fabric having an initial bulk recovery ratio of 60% or more and a prolonged bulk recovery ratio of 85% or more preferably is used in applications in which pressure repeatedly is applied in the thickness direction, for example, as cushioning materials, interior materials for vehicles, padding materials for brassieres, and the like, or used instead of urethane foam.

(2) Hardness Test

The measurements in a hardness test are performed as defined in JIS-K-6401-5.4. It is preferable that the hardness of the nonwoven fabric $H_0$ (N) measured using the measurement method is 60 N or more, because sufficient hardness at the time of compression is obtained.

(3) Heating Hardness Retention

When the hardness of the nonwoven fabric measured as defined in JIS-K-6401-5.4 (hardness test) is taken as $H_0$ (N), and the hardness of the nonwoven fabric in the hardness test, after performing a compressive residual strain test in which the measurement is performed as defined in JIS-K-6401-5.5 (compressive residual strain test), is taken as $H_1$ (N), the nonwoven fabric has a heating hardness retention represented by the following equation of preferably 90% or more, more preferably 100% or more, and even more preferably 105% or more. The heating hardness retention is an index indicating the degree of a change in hardness of the nonwoven fabric before and after the fabric is heated to 70° C. It is shown that the deterioration of a fiber or a nonwoven fabric itself due to heat is suppressed more reliably as this value is larger.

$$\text{Heating hardness retention}(\%)=(H_1/H_0)\times 100$$

It is preferable that a nonwoven fabric that falls within this range is a needle-punched nonwoven fabric, or a nonwoven fabric in which fibers are arranged either perpendicularly or diagonally with respect to the thickness direction.

(4) Durable Hardness Retention

When the hardness of the nonwoven fabric measured as defined in JIS-K-6401-5.4 (hardness test) is taken as $H_0$ (N), and the hardness of the nonwoven fabric in the hardness test, after performing a repetitive compressive residual strain test in which the measurement is performed as defined in JIS-K-6401-5.6 (repetitive compressive residual strain test), is taken as $H_2$ (N), the nonwoven fabric has a durable hardness retention represented by the following equation of preferably 90% or more, and more preferably 100% or more. The durable hardness retention is an index indicating the degree of a change in hardness of the nonwoven fabric before and after the fabric is subjected to 50% compression 80000 times. It is shown that the deterioration of a fiber or a nonwoven fabric itself due to compression is suppressed more reliably as this value is larger.

$$\text{Durable hardness retention}(\%)=(H_2/H_0)\times 100$$

It is preferable that a nonwoven fabric that falls within this range is a needle-punched nonwoven fabric, or a nonwoven fabric in which fibers are arranged either perpendicularly or diagonally with respect to the thickness direction.

(5) Thermal Fusing Treatment

A nonwoven fabric that satisfies the heating hardness retention and/or the durable hardness retention can be obtained, for example, as a fiber assembly that has been entangled using a known method, such as needle punching or hydro-entanglement, in which at least the PB-1 of the crimping conjugate fiber, and preferably the PB-1 and the PP are melted by heat so that fiber-connecting points are bonded to each other.

EXAMPLES

Hereinafter, the present invention will be described in more detail by way of examples. It should be noted that the characteristics were measured using the following methods.

(1) Physical Properties of Polymer Used

The IV stands for the intrinsic viscosity of the polymer as described above. MFR stands for the melt flow rate measured as defined in JIS-K-7210 at 230° C. and 21.18 N (2.16 kgf). MFR (190° C.) stands for the melt flow rate of a polymer measured as defined in JIS-K-7210 at a measurement temperature of 190° C. and 21.18 N (2.16 kgf).

In the present invention, the melting initiation temperature refers to an extrapolated melting initiation temperature as defined in JIS-K-7121. The extrapolated melting initiation temperature is a temperature represented by an intersecting point between a straight line that is obtained by extending the baseline on the lower-temperature side to the higher temperature side and a tangent that is obtained at a point with the largest gradient on the curve of the melting peak on the lower-temperature side, that is, a temperature at which an endothermic reaction leading to the melting peak temperature is initiated.

The Q value was measured under the following conditions.

I. Analyzing Apparatuses Used (i) Cross-Fractionation Apparatus

CFC T-100 (abbreviated as CFC) manufactured by DIA Instruments Co., Ltd (ii) Fourier Transform Infrared Absorption Spectrometer FT-IR, 1760X manufactured by PerkinElmer, Inc.

A fixed wavelength infrared spectrophotometer that was attached as a detector of CFC was removed and replaced by FT-IR spectrometer, and this FT-IR spectrometer was used as the detector. The transfer line from the outlet of a solution eluted from the CFC to the FT-IR spectrometer was 1 m and maintained at a temperature of 140° C. throughout the measurement. The flow cell attached to the FT-IR spectrometer had an optical path length of 1 mm and an optical path diameter of 5 mmϕ and was maintained at a temperature of 140° C. throughout the measurement.

(iii) Gel Permeation Chromatography (GPC)

Three GPC columns AD806MS manufactured by Showa Denko K.K. connected in series were used in the latter portion of the CFC.

II. Measurement Conditions using the CFC (i) Solvent: ortho dichlorobenzene (ODCB)

(ii) Sample concentration: 1 mg/ml (iii) Injection amount: 0.4 ml (iv) Column temperature: 140° C.

(v) Solvent flow rate: 1 ml/min.

III. Measurement Conditions using the FT-IR Spectrometer

After elution of the sample solution from the GPC in the latter portion of the CFC started, FT-IR measurement was performed under the following conditions, and GPC-IR data was collected.

(i) Detector: MCT (ii) Resolution: 8 $cm^{-1}$ (iii) Measurement interval: 0.2/min. (12 sec)

(iv) Number of scans per measurement: 15 times

IV. Post-Processing and Analysis of Measurement Results

The molecular weight distribution was determined using the absorbance at 2945 $cm^{-1}$ obtained by FT-IR as a chromatogram. The retention volume was converted to the molecular weight using a calibration curve prepared in advance with standard polystyrenes. The standard polystyrenes used were F380, F288, F128, F80, F40, F20, F10, F4, F1, A5000, A2500, and A1000, all of which are manufactured by Tosoh Corporation. A calibration curve was formed by injecting 0.4 ml of a solution in which 0.5 mg/ml of each standard polystyrene was dissolved in ODCB (containing 0.5 mg/ml of BHT). The calibration curve employed a cubic equation obtained by approximation using the least squares method. The conversion to the molecular weight employed a universal calibration curve by referring to Sadao Mori, *Size Exclusion Chromatography* (Kyoritsu Shuppan). The following numerical values were used in the viscosity expression ($[\eta]=K\times M\alpha$) used herein.

(i) In the formation of the calibration curve using standard polystyrenes $$K=0.000138,\ \alpha=0.70$$

(ii) In the measurement of polypropylene samples $$K=0.000103,\ \alpha=0.78$$

The measurements were performed using the GPC (gel permeation chromatography), but the measurements may be performed using another model. In this case, measurements were performed simultaneously with MG03B manufactured by Japan Polypropylene Corporation, which is described in the 2005 Catalogue for commercial transaction of plastic molding materials (the Chemical Daily Co., Ltd., Aug. 30, 2004), the value at which 3.5 was obtained in the MG03B was taken as a blank condition, and the conditions were adjusted to perform the measurements.

(2) Measurement Methods

Dry Thermal Shrinkage Ratio: The measurement was performed as defined in JIS-L-1015. Dry heating was performed at initial loads of 0.018 mN/dtex (2 mg/de) and 0.45 mN/dtex (50 mg/de) at 120° C. for 15 minutes, and, thus, shrinkage ratios were measured.

Area Shrinkage Ratio: The area reduction ratio was measured when a web after carding and before heating was cut into a piece having a length of 100 mm and a width of 100 mm and heated at a predetermined temperature.

25° C. Bulk Recovery Ratio: A necessary number of layers obtained by cutting the nonwoven fabric into a square piece with 100 mm-long sides were stacked so that the total mass per unit area was approximately 1000 g/$m^2$, and an initial thickness ($T_0$) was measured in a no-load condition. A weight having a load of 9.8 kPa in the shape of a square with 100 mm-long sides was placed on the stacked nonwoven fabric layers. The load was applied at 25° C. for 24 hours, and removed 24 hours later. A thickness ($T_1$) of the stacked nonwoven fabric layers immediately after removal of the load and a thickness ($T_2$) at 24 hours after removal of the load were measured, and the bulk recovery ratios of the nonwoven fabric were calculated using the following equations.

$$\text{Initial bulk recovery ratio}(\%)=(T_1/T_0)\times 100$$

$$\text{Prolonged bulk recovery ratio}(\%)=(T_2/T_0)\times 100$$

All thicknesses were measured in an unloaded state.

70° C. Bulk Recovery Ratio: The measurement was performed as described above, except that the temperature was set to 70° C., and the load was applied for 4 hours.

Apparent Density The measurement was performed as defined in JIS-K-6401-5.3 (apparent density test).

Hardness: The measurement was performed as defined in JIS-K-6401-5.4 (hardness test).

Compressive Residual Strain: The measurement was performed as defined in JIS-K-6401-5.5 (compressive residual strain test).

Repetitive Compressive Residual Strain: The measurement was performed as defined in JIS-K-6401-5.6 (repetitive compressive residual strain test).

Examples 1 to 7 and Comparative Examples 1 to 3

1. Production Conditions of the Fibers (A) Polymers Used (Each abbreviation indicates the following)

(1) PTT (CORTERRA9200 manufactured by Shell Chemicals Japan Ltd., glass transition point 45° C., melting peak temperature (mp) 228° C., 1V value 0.92, melting initiation temperature 213° C.)

(2) PET (T200E manufactured by Toray Industries, Inc., mp 255° C., IV value 0.64)

(3) PP-I (SA03E manufactured by Japan Polypropylene Corporation, mp 160° C., MFR 20, Q value 5.6)

(4) PP-2 (SAO3B manufactured by Japan Polypropylene Corporation, mp 160° C., MFR 30, Q value 3.6)

(5) PP-3 (SA01A manufactured by Japan Polypropylene Corporation, mp 160° C., MFR 9, Q value 3.2)

(6) PP-4 (CJ700 manufactured by Prime Polymer Co., Ltd., mp 160° C., MFR 7, Q value 6.5)

(7) PB-1a (PB0400 manufactured by SunAllomer Ltd., mp 123° C., MFR (190° C.) 20)

(8) PB-1b (DP0401M manufactured by SunAllomer Ltd., mp 123° C., MFR (190° C.) 15)

(9) PBT elastomer (Hytrel 4047H-36 manufactured by Du Pont-Toray Co., Ltd., mp 160° C.)

(10) HDPE (HE481 manufactured by Japan Polyethylene Corporation, mp 130° C., MFR (190° C.) 12)

Tables 1 and 2 show the blending ratios of the sheath component.

(B) Extrusion temperature: 280° C. for the core component polymer (e.g., PIT), 250° C. for the sheath component polymer, 270° C. for the nozzle base (C) Number of nozzle holes: 600

(D) Combination ratio: core/sheath=55/45 (volume ratio)

(E) Undrawn fiber fineness: 8 dtex (F) Drawing temperature: wet (hot-water bath) 70° C.

(G) Drawing ratio: 2.3 times (H) Crimps: 12 to 15 per 25 mm (I) Annealing temperature (drying temperature): 110° C.×15 min.

(J) Product fiber fineness×fiber length: 4.4 dtex×51 mm

2. Production Conditions for the Nonwoven Fabrics

First, 100 mass % of each crimping conjugate fiber was loaded onto a carding machine to obtain a web. The web was heated using a hot air-circulating heating machine for 30 seconds at the treatment temperatures shown in Tables 1 and 2 so that the sheath component was thermally fused, and, thus, a nonwoven fabric having a mass per unit area of approximately 100 g/m$^2$ was obtained.

Tables 1 and 2 show the conditions and obtained results. In Examples 2, 4, and 6 and Comparative Example 2, treatment with hot air was performed while adjusting the thickness of each layer using a net so that the thickness of 10 layers stacked was 30 mm so as to match the initial thickness in Comparative Example 3.

TABLE 1

| | | Ex. No. | | | | | | |
|---|---|---|---|---|---|---|---|---|
| | | Ex. 1 | Ex. 2 | Ex. 3 | Ex. 4 | Ex. 5 | Ex. 6 | Ex. 7 |
| Core resin | | PET | PET | PTT | PTT | PTT | PTT | PTT |
| Sheath resin | Resin 1 | PB-1a | PB-1a | PB-1a | PB-1a | PB-1a | PB-1a | PB-1a |
| | Resin 2 | PP-2 | PP-2 | PP-2 | PP-2 | PP-2 | PP-2 | PP-2 |
| | Resin 1:Resin 2 | 80:20 | 80:20 | 80:20 | 80:20 | 90:10 | 90:10 | 95:5 |
| | Q Value of Resin 2 | 3.6 | 3.6 | 3.6 | 3.6 | 3.6 | 3.6 | 3.6 |
| | Amount added/ Q Value of Resin 2 | 5.56 | 5.56 | 5.56 | 5.56 | 2.78 | 2.78 | 1.39 |
| Eccentricity (%) | | 25 | 25 | 25 | 25 | 25 | 25 | 25 |
| Shape of crimps | | Wavy | Wavy | Wavy, spiral | Wavy, spiral | Wavy, spiral | Wavy, spiral | Wavy, spiral |
| Number of crimps (crimps per 25 mm) | | 13.1 | 13.1 | 14.0 | 14.0 | 15.3 | 15.3 | 15.5 |
| Dry thermal shrinkage ratio (%) (JIS 0.45 mN/dtex) | | 1.2 | 1.2 | 0.6 | 0.6 | 0.8 | 0.8 | 1.2 |
| Nonwoven fabric treatment temperature (° C.) | | 160 | 160 | 160 | 160 | 160 | 160 | 160 |
| Area shrinkage ratio (%) | | 1.2 | 1.2 | 0.1 | 0.1 | 0.5 | 0.5 | 1.5 |
| Initial thickness (mm) | | 50 | 30 | 55 | 30 | 55 | 30 | 55 |
| 25° C. Initial bulk recovery ratio (%) | | 67 | — | 76 | — | 77 | — | 78 |
| 25° C. Prolonged bulk recovery ratio (%) | | 85 | — | 91 | — | 92 | — | 93 |
| 70° C. Initial bulk recovery ratio (%) | | — | 62 | — | 65 | — | 66 | — |
| 70° C. Prolonged bulk recovery ratio (%) | | — | 73 | — | 77 | — | 77 | — |

TABLE 2

| | | Com. Ex. No. | | |
|---|---|---|---|---|
| | | Com. Ex. 1 | Com. Ex. 2 | Com. Ex. 3 |
| Core resin | | PTT | PTT | PTT |
| Sheath resin | Resin 1 | HDPE | HDPE | PBT elastomer |
| | Resin 2 | — | — | — |
| | Resin 1:Resin 2 | 100:0 | 100:0 | 100:0 |
| Eccentricity (%) | | 25 | 25 | 25 |
| Shape of crimps | | Wavy, spiral | Wavy, spiral | Saw-toothed, wavy |
| Number of crimps (crimps per 25 mm) | | 15.3 | 15.3 | 13.5 |
| Dry thermal shrinkage ratio (%) (JIS 0.45 mN/dtex) | | 0.1 | 0.1 | 1.1 |
| Nonwoven fabric treatment temperature (° C.) | | 135 | 135 | 160 |
| Area shrinkage ratio (%) | | 0.7 | 0.7 | 3.1 |
| Initial thickness (mm) | | 80 | 30 | 30 |
| 25° C. Initial bulk recovery ratio (%) | | 55 | — | 76 |
| 25° C. Prolonged bulk recovery ratio (%) | | 99 | — | 94 |
| 70° C. Initial bulk recovery ratio (%) | | — | 60 | 65 |
| 70° C. Prolonged bulk recovery ratio (%) | | — | 65 | 77 |

As clearly seen from these results, in Examples 1 to 7 of the present invention, the initial thickness at the same mass per unit area was large, and the initial bulk recovery ratio and the prolonged bulk recovery ratio were high, compared with Comparative Examples 1 to 3. In Examples 3 to 7, in which wavy crimps and spiral crimps were combined, the dry thermal shrinkage ratio of the single fiber and the area shrinkage ratio of the nonwoven fabric were low, the initial thickness of the nonwoven fabric was large, and the initial bulk recovery ratio and the prolonged bulk recovery ratio were high, compared with Examples 1 and 2. The reason for this seems to be that the second component (core component) comprised a polytrimethylene terephthalate.

In Comparative Examples 1 and 2, the initial thickness was high, but the initial bulk recovery ratio was low, compared with the examples.

In Comparative Example 3, the sheath component comprised a PBT elastomer, and, thus, the development of crimps was low. Furthermore, the dry thermal shrinkage ratio of the single fiber and the area shrinkage ratio of the nonwoven fabric were slightly large, compared with the examples. Accordingly, the initial thickness in the form of a nonwoven fabric increased only up to 30 mm, that is, the thickness of the nonwoven fabric was small.

Examples 8 to 15

Actualized crimping conjugate fibers of Examples 8 to 11 were produced using the same polymers and evaluation methods as those in Examples 1 to 8 under the conditions shown in Table 3. Table 3 shows the obtained results. Furthermore, 100 mass % of the crimping conjugate fiber obtained in Example 10 and Comparative Example 3 were loaded onto a carding machine to produce cross laid webs using a cross-layer. Then, each cross laid web was subjected to needle punching, using conical blades manufactured by Foster Needle at a needle depth of 5 mm and the number of penetrations (both on front and back) shown in Table 4. The obtained needle-punched nonwoven fabrics were heated using a hot air-circulating heating machine for 30 seconds at the treatment temperatures shown in Table 4 so that the sheath component was thermally fused, and, thus, nonwoven fabrics were obtained. Table 4 shows the results obtained by measuring the hardness, the compressive residual strain, the heating hardness retention, the repetitive compressive residual strain, and the durable hardness retention of the obtained nonwoven fabrics.

TABLE 3

| | | Ex. No. | | | | | | | |
|---|---|---|---|---|---|---|---|---|---|
| | | Ex. 8 | Ex. 9 | Ex. 10 | Ex. 11 | Ex. 12 | Ex. 13 | Ex. 14 | Ex. 15 |
| Core resin | | PTT | PTT | PTT | PTT | PTT | PTT | PTT | PTT |
| Sheath resin | Resin 1 | PB-1b | PB-1b | PB-1b | PB-1b | PB-1b | PB-1b | PB-1b | PB-1b |
| | Resin 2 | PP-1 | PP-1 | PP-1 | PP-1 | PP-3 | PP-3 | PP-4 | PP-4 |
| | Resin 1:Resin 2 | 90:10 | 90:10 | 85:15 | 85:15 | 90:10 | 90:10 | 90:10 | 90:10 |
| | Q Value of Resin 2 | 5.6 | 5.6 | 5.6 | 5.6 | 3.2 | 3.2 | 6.5 | 6.5 |
| | Amount added/ Q Value of Resin 2 | 1.79 | 1.79 | 2.67 | 2.67 | 3.13 | 3.13 | 1.53 | 1.53 |
| Eccentricity (%) | | 25 | 25 | 25 | 25 | 25 | 25 | 25 | 25 |
| Shape of crimps | | Wavy, spiral | Wavy, spiral | Wavy, spiral | Wavy, spiral | Wavy, spiral | Wavy, spiral | Wavy, spiral | Wavy, spiral |
| Number of crimps (crimps per 25 mm) | | 14.1 | 14.1 | 14.5 | 14.5 | 16.1 | 16.1 | 14.9 | 14.9 |
| Dry thermal shrinkage ratio (%) (JIS 0.45 mN/dtex) | | 1.7 | 1.7 | 0.2 | 0.2 | 0.1 | 0.1 | 2.0 | 2.0 |
| Nonwoven fabric treatment temperature (° C.) | | 160 | 160 | 160 | 160 | 160 | 160 | 160 | 160 |
| Area shrinkage ratio (%) | | 2.3 | 2.3 | 0.6 | 0.6 | 0.1 | 0.1 | 2.0 | 2.0 |
| Initial thickness (mm) | | 55 | 30 | 55 | 30 | 55 | 30 | 55 | 30 |
| 25° C. Initial bulk recovery ratio (%) | | 75 | — | 73 | — | 77 | — | 72 | — |
| 25° C. Prolonged bulk recovery ratio (%) | | 90 | — | 90 | — | 92 | — | 90 | — |
| 70° C. Initial bulk recovery ratio (%) | | — | 63 | — | 65 | — | 67 | — | 63 |
| 70° C. Prolonged bulk recovery ratio (%) | | — | 76 | — | 76 | — | 78 | — | 74 |

As clearly seen from the results in Table 3, in all of Examples 8 to 15 of the present invention, the initial thickness at the same mass per unit area was large, and the initial bulk recovery ratio and the prolonged bulk recovery ratio were high. In particular, in Examples 12 and 13, the Q value of the PP added to Resin 2 and the MFR were small, and the ratio of the amount of PP added to the Q value was large, and, thus, both the dry thermal shrinkage ratio of the single fiber and the area shrinkage ratio of the nonwoven fabric were extremely small.

TABLE 4

| | | Ex./Com. Ex. No. | | | |
|---|---|---|---|---|---|
| | | Ex. 10 | | | Com. Ex. 3 |
| Needle punching conditions | Needle depth (mm) | 5 | 5 | 5 | 5 |
| | Number of penetrations (N/cm$^2$) | 67.5 | 45.0 | 22.5 | 22.5 |
| Properties of needle punched nonwoven fabric | Mass per unit area (g/m$^2$) | 500 | 450 | 400 | 500 |
| | Thickness (mm) | 10 | 10 | 10 | 10 |
| | Apparent density (kg/m$^3$) | 50 | 45 | 40 | 50 |
| | Hardness (N) | 71 | 67 | 59 | 65 |
| | Compressive residual strain (%) | 27 | 28 | 30 | 35 |
| | Heating hardness retention (%) | 118 | 118 | 112 | 84 |
| | Repetitive compressive residual strain (%) | 11.8 | 9.7 | 6.5 | 8.2 |
| | Durable hardness retention (%) | 114 | 103 | 103 | 74 |

As clearly seen from the results in Table 4, in the needle-punched nonwoven fabric of Example 10, both the heating hardness retention and the durable hardness retention were 90% or more. The reason for this seems to be that the fiber-bonding points and the fiber itself were not broken or bent, or the fiber strength was not lowered, by either compression with heat or repetitive compression. On the other hand, in the nonwoven fabric of Comparative Example 3, the heating hardness retention was 84% and the durable hardness retention was 74%, which were low, and the hardness of the nonwoven fabric was reduced by compression with heat at 70° C. and compression repeated 80000 times, that is, the thermal resistance and the durability were poor.

Examples 16 to 20 and Comparative Examples 1 to 4

Hereinafter, a latently crimpable conjugate fiber and a nonwoven fabric using the same will be described by way of the following examples and comparative examples.

1. Production Conditions of the Fibers (A) Polymers Used (Each Abbreviation Indicates the Following)

(1) PTT (CORTERRA9240 manufactured by Shell Chemicals Japan Ltd., melting peak temperature (mp) 228° C., IV value 0.92, melting initiation temperature 213° C.)

(2) PP-(1) (SA03B manufactured by Japan Polypropylene Corporation, mp 160° C., MFR 30, Q value 3.6)

(3) Copolymer PP-(1) (FX4G manufactured by Japan Polypropylene Corporation, mp 125° C., MFR 5, Q value 5.5, binary)

(4) Copolymer PP-(2) (WINTEC WFX4 manufactured by Japan Polypropylene Corporation, mp 125° C., MFR 7, Q value 2.5, using metallocene catalyst, binary)

(5) Copolymer PP-(3) (F794NV manufactured by Prime Polymer Co., Ltd., mp 130° C., MFR 7, Q value 5.0, ternary)

(6) Copolymer PP-(4) (WINTEC WXK1183 manufactured by Japan Polypropylene Corporation, mp 128° C., MFR 26, Q value 2.6, metallocene catalyst, binary)

(7) PB-1(1) (DP0401M manufactured by SunAllomer Ltd., mp 123° C., MFR (190° C.) 15)

(8) PB-1(2) (PB0300 manufactured by SunAllomer Ltd., mp 123° C., MFR (190° C.) 4)

(9) HDPE (HE481 manufactured by Japan Polyethylene Corporation, mp 130° C., MFR (190° C.) 12)

(10) PBT elastomer (Hytrel 4047H-36 manufactured by Du Pont-Toray Co., Ltd., mp 160° C.)

Tables 5 and 6 show the blending ratios of the sheath component.

(B) Extrusion temperature: 280° C. for the core component polymer (e.g., PTT), 250° C. for the sheath component polymer, 270° C. for the nozzle base (C) Number of nozzle holes: 600

(D) Combination ratio: core/sheath=55/45 (volume ratio)

(E) Undrawn yarn fiber fineness: 12 dtex in Examples 16 to 18, 10 dtex in Example 19, 17.9 dtex in Comparative Example 4

(F) Drawing temperature: wet (hot-water bath) 70° C.

(G) Drawing ratio: 2.3 times in Examples 16 to 18, 1.9 times in Example 19, 3.2 times in Comparative Example 4

(H) Crimps: 12 to 15 crimps per 25 mm (I) Annealing temperature (drying temperature) and time: 70° C., 15/min.

(J) Product fiber fineness, fiber length: 6.7 dtex, 51 mm

2. Production Conditions of the Nonwoven Fabrics

First, 100 mass % of each latently crimpable conjugate fiber was loaded onto a carding machine to obtain a web. The web was heated using a hot air-circulating heating machine for 30 seconds at the treatment temperatures shown in Tables 5 and 6 so that the sheath component was thermally fused, and, thus, a nonwoven fabric having a mass per unit area of approximately 100 g/m$^2$ was obtained.

3. Production Conditions of the Needle-Punched Nonwoven Fabrics

First, 100 mass % of each latently crimpable conjugate fiber was loaded onto a carding machine to produce a cross laid web using a cross-layer. Then, the cross laid web was subjected to needle punching, using conical blades manufactured by Foster Needle at a needle depth of 5 mm and the number of penetrations (both on front and back) shown in Tables 5 and 6. The obtained needle-punched nonwoven fabric was heated using a hot air-circulating heating machine for 30 seconds at the treatment temperatures shown in Tables 5 and 6 so that the sheath component was thermally fused, and, thus, a nonwoven fabric was obtained. Tables 5 and 6 show the results obtained by measuring the hardness, the compressive residual strain, the heating hardness retention, the repetitive compressive residual strain, and the durable hardness retention of the obtained nonwoven fabric. The fabric of Example 20 was produced by mixing 50 mass % of the latently crimpable fiber of Example 16 and 50 mass % of polyethylene terephthalate hollow single fiber (T-70 manufactured by Toray Industries, Inc.) having a fiber fineness of 6.7 dtex and a fiber length of 64 mm.

TABLE 5

| | | Ex. No. | | | | | | | |
|---|---|---|---|---|---|---|---|---|---|
| | | Ex. 16 | | Ex. 17 | | Ex. 18 | | Ex. 19 | |
| Core resin | | PTT | | PTT | | PTT | | PTT | |
| Sheath resin | Resin 1 | PB-1(1) | | PB-1(1) | | PB-1(1) | | PB-1(2) | |
| | Resin 2 | Copolymer PP-(1) | | Copolymer PP-(2) | | Copolymer PP-(3) | | — | |
| | Resin 1:Resin 2 | 85:15 | | 85:15 | | 85:15 | | 100:0 | |
| Eccentricity (%) | | 25 | | 25 | | 25 | | 25 | |
| Number of crimps (crests/25 mm) | | 14.8 | | 15.3 | | 15.8 | | 16.7 | |
| Dry thermal | JIS 0.018 mN/dtex | 81.6 | | 65.2 | | 68.1 | | 84.6 | |
| shrinkage ratio (%) | JIS 0.45 mN/dtex | 32.0 | | 21.1 | | 23.8 | | 7.4 | |
| Nonwoven fabric treatment temperature (° C., 30 sec) | | 140 | | 140 | | 140 | | 130 | |
| Area shrinkage ratio (%) | | 56.9 | | 43.4 | | 48.7 | | 39.6 | |
| Initial thickness (mm) | | 45 | 30 | 45 | 30 | 45 | 30 | 45 | 30 |
| 25° C. Initial bulk recovery ratio (%) | | 75 | — | 73 | — | 77 | — | 73 | — |
| 25° C. Prolonged bulk recovery ratio (%) | | 91 | — | 90 | — | 92 | — | 90 | — |
| 70° C. Initial bulk recovery ratio (%) | | — | 63 | — | 65 | — | 67 | — | 65 |
| 70° C. Prolonged bulk recovery ratio (%) | | — | 77 | — | 76 | — | 78 | — | 76 |
| Needle punching | Needle depth (mm) | 5 | | 5 | | 5 | | 5 | |
| | Number of penetrations (N/cm$^2$) | 30 | | 30 | | 30 | | 30 | |
| | Mass per unit area (g/m$^2$) | 450 | | 450 | | 450 | | 450 | |

TABLE 5-continued

| | | Ex. No. | | | |
|---|---|---|---|---|---|
| | | Ex. 16 | Ex. 17 | Ex. 18 | Ex. 19 |
| Properties of nonwoven fabric | Thickness (mm) | 10 | 10 | 10 | 10 |
| | Apparent density (kg/m$^3$) | 45 | 45 | 45 | 45 |
| | Hardness (N) | 93 | 85 | 84 | 91 |
| | Compressive residual strain (%) | 30 | 30 | 30 | 30 |
| | Heating hardness retention (%) | 115 | 115 | 115 | 115 |
| | Repetitive compressive residual strain (%) | 9.8 | 10.0 | 10.0 | 10.0 |
| | Durable hardness retention (%) | 104 | 103 | 100 | 100 |

TABLE 6

| | | Ex./Com. Ex. No. | | | |
|---|---|---|---|---|---|
| | | Ex. 20 | Com. Ex. 4 | Com. Ex. 1, 2 | Com. Ex. 3 |
| Core resin | | PTT | PP-(1) | PTT | PTT |
| Sheath resin | Resin 1 | PB-1(1) | Copolymer PP-(4) | HDPE | PBT elastomer |
| | Resin 2 | Copolymer PP-(1) | — | — | — |
| | Resin 1:Resin 2 | 85:15 | 100:0 | 100:0 | 100:0 |
| Eccentricity (%) | | 25 | 25 | 25 | 25 |
| Number of crimps (crests/25 mm) | | 14.8 | 14.9 | 15.3 | 13.5 |
| Dry thermal shrinkage ratio (%) | JIS 0.018 mN/dtex | 81.6 | 80.3 | — | — |
| | JIS 0.45 mN/dtex | 32.0 | 20.5 | 1.1 | 1.1 |
| Nonwoven fabric treatment temperature (° C., 30 sec) | | 140 | 140 | 140 | 160 |
| Area shrinkage ratio (%) | | 17.8 | 86.7 | 0.7 | 3.1 |
| Initial thickness (mm) | | 45 30 | 45 30 | 80 30 | 30 — |
| 25° C. Initial bulk recovery ratio (%) | | 77 — | 62 — | 55 — | 76 — |
| 25° C. Prolonged bulk recovery ratio (%) | | 90 — | 70 — | 90 — | 94 — |
| 70° C. Initial bulk recovery ratio (%) | | — 67 | — 65 | — 60 | 65 — |
| 70° C. Prolonged bulk recovery ratio (%) | | — 79 | — 76 | — 65 | 77 — |
| Needle punching | Needle depth (mm) | 5 | 5 | — | 5 |
| | Number of penetrations (N/cm$^2$) | 30 | 22.5 | — | 22.5 |
| | Mass per unit area (g/m$^2$) | 450 | 500 | — | 500 |
| Properties of nonwoven fabric | Thickness (mm) | 10 | 10 | — | 10 |
| | Apparent density (kg/m$^3$) | 45 | 50 | — | 50 |
| | Hardness (N) | 48 | 55 | — | 65 |
| | Compressive residual strain (%) | 33 | 40 | — | 35 |
| | Heating hardness retention (%) | 100 | 81 | — | 84 |
| | Repetitive compressive residual strain (%) | 14 | 25.0 | — | 8.2 |
| | Durable hardness retention (%) | 95 | 80 | — | 74 |

As clearly seen from these results, in the nonwoven fabrics in Examples 16 to 19 of the present invention, the compression hardness was high, and the elasticity was good, compared with the nonwoven fabric in Comparative Example 4. The reason for this seems to be that three-dimensional crimps in the shape of loops were developed in the fibers of the nonwoven fabrics. Furthermore, in the nonwoven fabrics in Examples 16 to 20, the initial bulk recovery ratio and the prolonged bulk recovery ratio were high, and the heating hardness retention and the durable hardness retention were also high. The reason for this seems to be that the first component (sheath component) comprised PB-1 and the second component (core component) comprised a polytrimethylene terephthalate.

When a plurality of layers of the web after carding were staked and shaped by heat, the compression hardness in Example 20 was lowered slightly because PET fiber was mixed in the fabric, but the nonwoven fabrics in Examples 16 to 20 of the present invention had excellent elasticity because the fiber layers were entangled to thereby develop integrity. On the other hand, Comparative Examples 3 and 4 did not comprise PB-1, and, thus, the bulk recovery property and the compression properties (compression hardness, durable hardness retention) were insufficient. Furthermore, the nonwoven fabrics of Comparative Examples 1 to 3 did not comprise PB-1, and were made of the actualized crimping fibers, and, thus, the entanglement of fibers between web layers was weak and the layers easily were separated.

As described above, it was confirmed that the nonwoven fabric comprising the crimping conjugate fiber, in particular, the latently crimpable conjugate fiber of the present invention, has high elasticity and high bulk recovery property, and that the entanglement of fibers between layers is good and the integrity between layers is high when the plurality of layers of the nonwoven fabric were stacked and compression-shaped with the application of heat.

INDUSTRIAL APPLICABILITY

The nonwoven fabric comprising the crimping conjugate fiber of the present invention has an initial bulk and bulk recovery property that are better than those of a nonwoven fabric comprising a conventional elastomer conjugate fiber, and can be used also in low-density nonwoven fabric products, such as cushioning materials and other hard stuffing, hygienic materials, packaging materials, filters, materials for cosmetics, pads for women's brassieres, shoulder pads, and the like. Moreover, the nonwoven fabric comprising the crimping conjugate fiber of the present invention also has excellent bulk recovery property at a high temperature (e.g., approximately 60 to 90° C.), and can be used in fields that requires thermal resistance, for example, in cushioning materials for vehicles, backing materials for flooring with floor heating, and the like.

The invention claimed is:

1. A crimping conjugate fiber, comprising a first component and a second component, wherein the first component comprises a polymer blend containing at least 60 mass % and no greater than 95 mass % of polybutene-1 with at least 5 mass % and no greater than 40 mass % of olefin-based polymer different from the polybutene-1, the second component comprises a polymer having a melting peak temperature higher than that of the polybutene-1 by at least 20° C., or a polymer having a melting initiation temperature of at least 120° C., in a cross section of the fiber, the first component occupies at least 20% of the surface of the conjugate fiber, and the centroid position of the second component is shifted from the centroid position of the conjugate fiber, the conjugate fiber is an actualized crimping conjugate fiber in which three-dimensional crimps have been developed or a latently crimpable conjugate fiber in which three-dimensional crimps are developed by heating, and the three-dimensional crimps are at least one type of crimps selected from the group consisting of wavy crimps and spiral crimps.

2. The crimping conjugate fiber according to claim 1, wherein the second component is a polyester.

3. The crimping conjugate fiber according to claim 2, wherein the polyester is a polytrimethylene terephthalate.

4. The crimping conjugate fiber according to claim 1, wherein the polybutene-1 has a melting peak temperature measured using DSC as defined in JIS-K-7121 of 115 to 130° C., and a melt flow rate (MFR; measurement temperature 190° C., load 21.18 N (2.16 kgf)) measured as defined in JIS-K-7210 of 1 to 30 g/10 min.

5. The crimping conjugate fiber according to claim 1, wherein the olefin-based polymer different from the polybutene-1 of the first component is at least one selected from a polypropylene and a propylene copolymer.

6. The crimping conjugate fiber according to claim 5, wherein the conjugate fiber is an actualized crimping conjugate fiber.

7. The crimping conjugate fiber according to claim 6, wherein the polypropylene has a ratio (Q value) between a weight-average molecular weight (Mw) and a number-average molecular weight (Mn) of not greater than 6, and a melt flow rate (MFR; measurement temperature 230° C., load 21.18 N (2.16 kgf)) as defined in JIS-K-7210 of 5 to 30 g/10 min.

8. The crimping conjugate fiber according to claim 1, wherein the conjugate fiber is an actualized crimping conjugate fiber, and the number of crimps is 5 per 25 mm to 25 per 25 mm.

9. The crimping conjugate fiber according to claim 1, wherein the conjugate fiber is the latently crimpable conjugate fiber, and a dry thermal shrinkage ratio at 120° C. measured as defined in JIS-L-1015 is:

(1) at least 50% measured at an initial load of 0.018 mN/dtex (2 mg/de); and (2) at least 5% measured at an initial load of 0.45 mN/dtex (50 mg/de).

10. The crimping conjugate fiber according to claim 9, wherein the first component comprises the polybutene-1 and a propylene copolymer.

11. The crimping conjugate fiber according to claim 10, wherein the propylene copolymer is at least one type selected from an ethylene-propylene copolymer and an ethylene-butene-1-propylene terpolymer.

12. The crimping conjugate fiber according to claim 11, wherein the propylene copolymer is an ethylene-propylene copolymer having a ratio (Q value) between a weight-average molecular weight (Mw) and a number-average molecular weight (Mn) of at least 3.

13. A nonwoven fabric comprising at least 30 mass % of a crimping conjugate fiber, wherein the crimping conjugate fiber comprises a first component and a second component, the first component comprises a polymer blend containing at least 60 mass % and no greater than 95 mass % of polybutene-1 with at least 5 mass % and no greater than 40 mass % of olefin-based polymer different from the polybutene-1, the second component comprises a polymer having a melting peak temperature higher than that of the polybutene-1 by at least 20° C., or a polymer having a melting initiation temperature of at least 120° C., in a cross section of the fiber, the first component occupies at least 20% of the surface of the conjugate fiber, and the centroid position of the second component is shifted from the centroid position of the conjugate fiber, the conjugate fiber is an actualized crimping conjugate fiber in which three-dimensional crimps have been developed or a latently crimpable conjugate fiber in which three-dimensional crimps are developed by heating, and the three-dimensional crimps are at least one type of crimps selected from the group consisting of wavy crimps and spiral crimps.

14. The nonwoven fabric according to claim 13, wherein at least the polybutene-1 of the crimping conjugate fiber is melted so that fiber portions are thermally fused.

15. A nonwoven fabric product formed of the nonwoven fabric according to claim 13, wherein the nonwoven fabric product is shaped to be a cushioning material, a hard stuffing, a hygienic material, a packaging material, a filter, a material for cosmetics, a pad for a brassiere, a shoulder pad, a cushioning material for vehicle, or a backing material for flooring.

16. The crimping conjugate fiber according to claim 1, wherein a combination ratio of the second component to the first component is 8/2 to 3/7 as a volume ratio.

17. The crimping conjugate fiber according to claim 1, wherein the cross-section of the conjugate fiber is an eccentric sheath-core type, and an eccentricity expressed by following equation (2) is 5 to 50%:

$$\text{Eccentricity}(\%)=[|Cf-C1|/rf]\times 100 \quad (2),$$

where C1 represents the centroid position of the second component, Cf represents the centroid position of the conjugate fiber, and rf represents a radius of the conjugate fiber.

18. The crimping conjugate fiber according to claim 1, wherein the polybutene-1 is a polymer having substantially no polar group.

19. The crimping conjugate fiber according to claim 1, wherein the olefin-based polymer different from the polybutene-1 is a polymer having substantially no polar group.

20. The crimping conjugate fiber according to claim 1, wherein the polybutene-1 and the olefin-based polymer different from the polybutene-1 are polymers having substantially no polar group.

* * * * *